US007393820B2

(12) United States Patent
Soldanski et al.

(10) Patent No.: US 7,393,820 B2
(45) Date of Patent: Jul. 1, 2008

(54) TRANSPARENT ABRASIVE CLEANING PRODUCT, ESPECIALLY MANUAL DISHWASHING LIQUID

(75) Inventors: Heinz-Dieter Soldanski, Essen (DE); Brigitie Giesen, Duesseldorf (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 0 days.

(21) Appl. No.: 11/636,168

(22) Filed: Dec. 8, 2006

(65) Prior Publication Data

US 2007/0167345 A1 Jul. 19, 2007

Related U.S. Application Data

(63) Continuation of application No. 11/105,749, filed on Apr. 14, 2005, now abandoned.

(51) Int. Cl.
*C11D 1/88* (2006.01)
*C11D 3/14* (2006.01)
*C11D 9/20* (2006.01)

(52) U.S. Cl. ..... 510/483; 510/236; 510/238; 510/239; 510/240; 510/397; 510/421; 510/426; 510/432; 510/474; 510/492; 510/505

(58) Field of Classification Search ..... 510/236, 510/238, 239, 240, 397, 421, 426, 432, 474, 510/483, 492, 505
See application file for complete search history.

(56) References Cited

U.S. PATENT DOCUMENTS 5,958,856 A * 9/1999 Yianakopoulos et al. .... 510/236
5,985,817 A 11/1999 Weibel et al.
6,159,925 A * 12/2000 Blandiaux ..... 510/437

FOREIGN PATENT DOCUMENTS

| | | | |
|---|---|---|---|
| CA | 2306376 | | 10/2000 |
| DE | 3439872 | A1 | 7/1985 |
| DE | 19918267 | A1 | 10/2000 |
| EP | 0522506 | A2 | 1/1993 |
| EP | 0292910 | B1 | 12/1994 |
| WO | WO 97/00609 | A1 | 1/1997 |
| WO | WO 97/43392 | A1 | 11/1997 |
| WO | WO 00/36078 | A1 | 6/2000 |
| WO | WO 01/19946 | A1 | 3/2001 |
| WO | WO 01/77278 | A1 | 10/2001 |
| WO | WO 02/38720 | A1 | 5/2002 |

OTHER PUBLICATIONS

H.W. Stache (ed), "Anionic Surfactants: organic chemistry", Surfactant Series, vol. 56, ISBN 0-8247-9394-3, Marcel Dekker, Inc. New York, pp. 501-549 (1996), no month given.

Wallhauser, "Praxis der Sterilisation, Desinfektion-Konservierung: Keimidentifizierung-Betriebshygiene", 5th Edition, Stuttgart: New York: Thieme (1995), no month given ; not translated.

* cited by examiner

*Primary Examiner*—Brian P Mruk
(74) *Attorney, Agent, or Firm*—John E. Drach

(57) ABSTRACT

A substantially transparent, liquid cleaning product for hard surfaces, comprising at least 15% by weight of a surfactant and one or more abrasive materials selected from the group consisting of polymers having a diameter of from 0.6 to 4 mm, natural materials having a diameter of from 0.05 to 4 mm, and mixtures thereof.

23 Claims, No Drawings

TRANSPARENT ABRASIVE CLEANING PRODUCT, ESPECIALLY MANUAL DISHWASHING LIQUID

CROSS-REFERENCE TO RELATED APPLICATIONS

This application is a continuation of U.S. patent application Ser. No. 11/105,749, filed Apr. 14, 2005 now abandoned. This application claims priority under 35 U.S.C. § 365(c) and 35 U.S.C. § 120 of International Application PCT/EP2003/011052, filed on Oct. 7, 2003. This application also claims priority under 35 U.S.C. § 119 of DE 102 48 313.2, filed Oct. 16, 2002, which is incorporated herein by reference in its entirety.

BACKGROUND OF THE INVENTION.

The invention relates to liquid abrasive-containing cleaning products for hard surfaces which are substantially transparent and contain more than 15% by weight of surfactant.

Conventional abrasive-containing liquid cleaning products for hard surfaces are typically milky, opaque, thick solutions. They are also well known to the German consumer as "scouring milk," a name which likewise reflects the whitish, opaque appearance of these products.

In contrast, manual dishwashing liquids typically have a transparent appearance. The clear products in conjunction with the usually used luminous dyes apparently have a particularly positive effect on the consumer, since they are associated with a particularly high cleaning performance. It is also desired that manual dishwashing liquids, in particular, form a sufficient foam, since the consumer also associates this with a good cleaning performance. Finally, a certain surfactant content is also required to ensure a good cleaning performance.

The international patent application WO 02/38720 describes clear surfactant-containing cleaning gels comprising macroscopic abrasive particles. Such particles may be inorganic substances, or else polymer granules or hard waxes. The surfactant content is between 0.1 and 15%. The gels are used to clean hard surfaces. Products having surfactant contents above 15% by weight are not disclosed.

The patent EP 292 910 describes a stable liquid aqueous scouring cleaning product for hard surfaces. In this product, the abrasive particles are intended not to scratch the surface to be cleaned. Various plastics are proposed as abrasives, and the particles can have a size of from 10 to 150 μm. The cleaners described, which are referred to many times as "creamy", are clearly "scouring milk"; in contrast, transparent products are not envisaged. In addition, the products are alkaline with a pH between 10 and 12.

WO 00/36078 provides transparent or translucent liquid products for textiles in which encapsulated active, ingredients are suspended with the aid of polymeric thickeners. These active ingredients are enzymes, bleaches, perfumes, etc. which are to be incorporated stably in the liquid product. In contrast, abrasives are not envisaged as ingredients.

The German application DE-A 19918267 finally describes manual dishwashing liquids in which microcapsules comprising various active ingredients are suspended. An abrasive action of these suspended particles is not envisaged here either, but rather the shell of the microcapsules opens on use and releases the active ingredient present.

Manual dishwashing liquids and other cleaning products for hard surfaces which exhibit good cleaning performance and comprise an abrasive to remove strongly adhering soils without scratching the surface to be cleaned in the course of use, but at the same time having an appearance attractive to the consumer, have not been described to date.

It is therefore an object of the present invention to provide a cleaning product for hard surfaces which comprises an abrasive, has good cleaning performance and is additionally visually attractive.

DESCRIPTION OF THE INVENTION

The invention therefore provides an abrasive-containing liquid cleaning product for hard surfaces which is substantially transparent and has a surfactant content of more than 15% by weight.

In the context of this invention, a "substantially transparent" product has a transmittance of light of any wavelengths in the visible range, i.e. between 400 and 800 nm, of at least 50%, measured in a cuvette with a layer thickness of 1 cm in the absence of dyes and abrasive particles. The light transmission is preferably above 70%, more preferably above 80%, in particular above 90%. The visual impression is preferably that of individual opaque particles suspended stably in a clear cleaning product. Just like the cleaning products surrounding them, these particles may assume any colors, and cleaning product and abrasive may be dyed in the same or different colors.

The surfactant content of more than 15% by weight refers to the total amount of anionic, nonionic and amphoteric surfactants, based on the cleaning product.

The present invention likewise provides for the use of the inventive product as a manual dishwashing liquid.

In this case, the product fulfills a dual function, since it can firstly, in particular in concentrated form, serve to preliminarily clean highly soiled tableware, soiled in some cases with burnt-on greasy soil or other impurities, the abrasives present contributing to more rapid release of the soiling substances. Secondly, it is also suitable in a customary manner for cleaning normally soiled tableware by introduction into a dilute aqueous cleaning liquor. The surfactant content of more than 15% by weight provides the product with good cleaning performance.

In addition to tableware, the products are capable of equally efficiently cleaning other hard surfaces, for example of glass, ceramic, plastic, enamel or metal, in the household and industry. For example, kitchen and in particular cooker surfaces, ovens and other hard surfaces with sometimes persistent and/or grease-containing soilings can be cleaned with inventive products, as can bathroom surfaces, plastic furniture in the house and garden or windows and other glass surfaces, to name just a few possibilities. Accordingly, the present invention further provides for the use of the inventive product as a manual cleaning product for hard surfaces.

In the context of the present invention, fatty acids, fatty alcohols and derivatives thereof represent, unless stated otherwise, respectively, branched or unbranched carboxylic acids, alcohols and derivatives thereof having preferably from 6 to 22 carbon atoms. Owing to their vegetable basis, the former are preferably based on renewable raw materials for ecological reasons, but without restricting the inventive teaching to them. In particular, the oxo alcohols or derivatives thereof obtainable by the ROELEN oxo process, for example, can also be used correspondingly.

Whenever alkaline earth metals are specified as counterions for monovalent anions hereinbelow, this means that the alkaline earth metal is of course present only in half the amount, which is sufficient to balance the charge, of the anion.

INCI means that the following or preceding designation is a name according to the *International Dictionary of Cosmetic Ingredients of The Cosmetic, Toiletry, and Fragrance Association* (*CTFA*). CAS means that the number which follows is a designation of the *Chemical Abstracts Service.*

Abrasives

In the context of this invention, the abrasives used may be substances which can be suspended as solids in the cleaning product and have a cleaning-promoting action in the inventive use of the product. This use lies in the scouring action of the particles, by means of which relatively strongly adhering soilings can also be detached and transferred into the cleaning liquor. However, it is necessary at the same time that the surface to be cleaned is not scratched, roughened or attacked in another way by the action of the abrasive. It is preferred that the particles do not have any sharp edges or tips. In particular, it is preferred when spherical or ellipsoidal, in some cases also drop-shaped, particles are used. The three-dimensional shape of these particles contributes not only to the surface-gentle property but also to the positive visual appearance of the inventive product.

In order to ensure an abrasive action over a prolonged period, it is also preferred that the abrasive particles are water-insoluble. When a mixture of different abrasives is used, preference is given to at least a portion thereof being water-insoluble, but a further portion may also be water-soluble.

The inventive products preferably comprise abrasives selected from the group consisting of polymers, hard waxes, natural materials, ceramic particles, inorganic substances and mixtures thereof.

In a preferred embodiment, the abrasives used are polymer particles. In this context, the polymer is preferably selected from the group consisting of polyethylene, polypropylene, polystyrene, polyethylene terephthalate, polyester, polycarbonate, polyvinyl chloride, polyvinyl acetate, polymethyl methacrylate and copolymers and mixtures thereof; particular preference is given to using polystyrene spheres which may or may not contain pentane, as obtainable commercially, for example, as "expandable polystyrene (EPS)" under various brand names from Nova Chemicals; likewise obtainable from Nova Chemicals are pentane-free polystyrene particles having a rubber core, obtainable, for example, under the name "Polystyrene 843M", which are likewise used with preference in inventive products.

A further preferred embodiment comprises abrasives which are obtained from natural materials. In the context of the invention, these include, for example, comminuted shells of hazelnuts, almonds, brazil nuts, walnuts, coconuts and further nuts, and also shells of the stones of various types of fruit, for example apricots, peaches, plums, etc., but also optionally comminuted kernels of grapes and various soft fruits such as strawberries, raspberries, blackberries, etc. Under some circumstances, comminuted roots or pieces of bark may also serve as abrasives. In the course of production of such abrasives obtained from natural materials, it is of particular importance that the formation of sharp-edged particles which under some circumstances attack the surface is prevented.

In addition to the abrasives mentioned, it is also possible to use hard waxes, ceramic particles, glass beads and inorganic substances as scouring particles in the context of the invention. The usable inorganic compounds include, for example, alkali metal carbonates, alkali metal bicarbonates and alkali metal sulfates, alkali metal borates, alkali metal phosphates, silicon dioxide, crystalline or amorphous alkali metal silicates and sheet silicates, finely crystalline sodium aluminum silicates, aluminum oxides and calcium carbonate.

In the context of the present invention, the abrasives used may be particles having a diameter of from 0.05 to 4 mm. They preferably have a diameter of from 0.3 to 1.5 mm. When the shape of the particles deviates from the spherical form, the particle diameter is averaged over the three spatial directions. The content in the product of abrasives is preferably from 0.05 to 10% by weight, more preferably from 0.3 to 2% by weight.

Thickeners

In the context of the present invention, thickeners are polycarboxylates, preferably homo- and copolymers of acrylic acid, in particular acrylic acid copolymers such as acrylic acid-methacrylic acid copolymers, and polysaccharides, in particular heteropolysaccharides, and other customary polymeric thickeners. In addition, it is also possible in the context of this invention to use sheet silicates and further inorganic substances known as thickeners to those skilled in the art; mixtures of different thickeners may also be used. It merely has to be ensured that, when the thickener is used, the substantially transparent visual appearance is retained. However, preference is given to polymers, in particular polycarboxylates and/or polysaccharides, as thickeners in inventive cleaning products.

Suitable polysaccharides or heteropolysaccharides are the polysaccharide gums, for example gum Arabic, agar, alginates, carrageenans and salts thereof, guar, guaran, tragacanth, gellan, ramsan, dextran or xanthan and derivatives thereof, for example propoxylated guar, and mixtures thereof. Other polysaccharide thickeners such as starches or cellulose derivatives may be used alternatively, but preferably additionally, to a polysaccharide gum, for example starches from a wide variety of origins and starch derivatives, for example hydroxyethyl starch, starch phosphate esters or starch acetates, or carboxymethylcellulose or its sodium salt, methyl-, ethyl-, hydroxyethyl-, hydroxypropyl-, hydroxypropylmethyl- or hydroxyethylmethylcellulose or cellulose acetate.

A preferred polymer is the microbial anionic heteropolysaccharide xanthan gum which is produced with a molecular weight of $2\text{-}15\times10^6$ under aerobic conditions by Xanthomonas campestris and some other species, and is obtained, for example, from Kelco under the trade names Keltrol® and Kelzan® or else from Rhodia under the trade name Rhodopol®.

A further preferred polymer is the likewise microbial heteropolysaccharide gellan gum which is formed under aerobic conditions, for example, by *Auromonas elodea* and in particular by *Sphingomonas paucimobilis* strains. Gellan gum can be purchased, for example, in various qualities from Kelco under the trade name Kelcogel®.

Suitable acrylic acid polymers are, for example, high molecular weight homopolymers of acrylic acid which have been crosslinked with a polyalkenyl polyether, in particular an allyl ether of sucrose, pentaerythritol or propylene (INCI carbomer), which are also referred to as carboxyvinyl polymers. Such polyacrylic acids are obtainable, inter alia, from BF Goodrich under the trade name Carbopol®.

However, particularly suitable polymers are the following acrylic acid copolymers: (i) copolymers of two or more monomers from the group of acrylic acid, methacrylic acid and their simple esters formed preferably with $C_{1-4}$-alkanols (INCI acrylates copolymer), which include, for instance, the copolymers of methacrylic acid, butyl acrylate and methyl methacrylate (CAS 25035-69-2) or of butyl acrylate and methyl methacrylate (CAS 25852-37-3) and which are obtainable, for example, from Rohm & Haas under the trade names Aculyn® and Acusol® and from Degussa (Goldschmidt) under the trade name Tego® polymer; (ii) crosslinked high molecular weight acrylic acid copolymers which include, for instance, the copolymers of $C_{10-30}$-alkyl acrylates which have been crosslinked with an allyl ether of sucrose or of pentaerythritol and have one or more monomers from the group of acrylic acid, methacrylic acid and their simple esters formed preferably with $C_{1-4}$-alkanols (INCI acrylates/C10-30 Alkyl Acrylate Crosspolymer), and which are obtainable, for example, from BF Goodrich under the trade name Carbopol®.

The inorganic thickeners used may in particular be sheet silicates. These include, for example, the magnesium or sodium-magnesium sheet silicates from Solvay Alkali which are obtainable, for example, under the trade name Laponite®, in particular Laponite® RD or else Laponite® RDS, and the magnesium silicates from Süd-Chemie, in particular Optigel® SH.

The thickener is always selected with the proviso that the substantially transparent visual appearance should be retained, i.e. opacifications resulting from the thickener should be substantially avoided. The content of thickeners is typically between 0.01 and 8% by weight, preferably between 0.1 and 6% by weight, more preferably between 0.5 and 3% by weight, for example between 0.5 and 1% by weight or between 2 and 3% by weight. The viscosity of the inventive product is adjusted or controlled substantially via the content of thickener, and the required amounts may be different from thickener to thickener. The surfactant mixture used also plays a role in the selection of amounts.

Electrolyte Salts

Depending on the thickener used, it may be desirable to additionally use electrolyte salts for stabilization. Electrolyte salts in the context of this invention are salts of preferably polyvalent cations with inorganic acid radicals. Especially preferred in this context are the chlorides and sulfates of the alkaline earth metals, of aluminum and of zinc, in particular aluminum chloride. The use of these electrolyte salts is advantageous. in particular in conjunction with poly-saccharide thickeners such as xanthan or gellan.

Surfactants

The inventive cleaning product comprises one or more surfactants selected from the group consisting of anionic surfactants, nonionic surfactants, amphoteric surfactants and mixtures thereof. In total, the surfactants are used typically in amounts of from more than 15 to 40% by weight, preferably from 16 to 35% by weight.

Anionic Surfactants

According to the invention, anionic surfactants may be aliphatic sulfates such as fatty alcohol sulfates, fatty alcohol ether sulfates, dialkyl ether sulfates, monoglyceride sulfates and aliphatic sulfonates such as alkanesulfonates, olefinsulfonates, ether sulfonates, n-alkyl ether sulfonates, ester sulfonates and lignosulfonates. Likewise usable in the context of the present invention are alkylbenzenesulfonates, fatty acid cyanamides, sulfosuccinic esters, fatty acid isothionates, acylaminoalkanesulfonates (fatty acid taurides), fatty acid sarcosinates, ethercarboxylic acids and alkyl (ether) phosphates.

The alkyl ether sulfates, alkyl- and/or arylsulfonates and/or alkyl sulfates and the further, anionic surfactants are used typically in the form of alkali metal, alkaline earth metal and/or mono-, di- or trialkanolammonium salts and/or else in the form of their corresponding acid to be neutralized in situ with the appropriate alkali metal hydroxide, alkaline earth metal hydroxide and/or mono-, di- or trialkanolamine. Preference is given in this context to potassium and in particular, sodium as alkali metals, to calcium and in particular magnesium as alkaline earth metals, and to mono-, di- or triethanolamine as alkanolamines. Particular preference is given to the sodium salts.

Alkyl Ether Sulfates

Alkyl ether sulfates (fatty alcohol ether sulfates, INCI Alkyl Ether Sulfates) are products of sulfation reactions on alkoxylated alcohols. Those skilled in the art generally understand alkoxylated alcohols as being the reaction products of alkylene oxide, preferably ethylene oxide, with alcohols, in the context of the present invention preferably with relatively long-chain alcohols, i.e. with aliphatic straight-chain or mono- or polybranched, acyclic or cyclic, saturated or mono- or polyunsaturated, preferably straight-chain, acyclic, saturated, alcohols having from 6 to 22, preferably from 8 to 18, in particular from 10 to 16 and more preferably from 12 to 14, carbon atoms. In general, n moles of ethylene oxide and one mole of alcohol, depending on the reaction conditions, form a complex mixture of addition products of different degrees of ethoxylation (n=from 1 to 30, preferably from 0.3 to 20, in particular from 0.3 to 10, more preferably from 0.3 to 5). A further embodiment of the alkoxylation consists in the use of mixtures of alkylene oxides, preferably of the mixture of ethylene oxide and propylene oxide. Very particular preference is given in the context of the present invention to low-ethoxylated fatty alcohols having from 0.3 to 4 ethylene oxide units (EO), in particular from 0.3 to 2 EO, for example 0.5 EO, 1.0 EO, 1.3 EO and/or 2.0 EO, such as Na $C_{12-14}$-fatty alcohol+0.5EO sulfate, Na $C_{12-14}$-fatty alcohol+1.3EO sulfate, Na $C_{12-14}$-fatty alcohol+2.0EO sulfate and/or Mg—$C_{11-14}$-fatty alcohol+1.0EO sulfate.

The inventive product may comprise one or more alkyl ether sulfates in an amount of typically from 1 to 40% by weight, preferably from 3 to 30% by weight, in particular from more than 6 to 26% by weight, more preferably from 8 to 20% by weight, exceptionally preferably from 10 to 16% by weight.

Alkyl- and/or Arylsulfonates

The alkylsulfonates (INCI Sulfonic Acids) typically have an aliphatic straight-chain or a mono- or polybranched, acyclic or cyclic, saturated or mono- or polyunsaturated, preferably branched, acyclic, saturated, alkyl radical having from 6 to 22, preferably from 9 to 20, in particular from 11 to 18 and more preferably from 13 to 17, carbon atoms.

Suitable alkylsulfonates are accordingly the saturated alkanesulfonates, the unsaturated olefinsulfonates and the ether sulfonates (derived in a formal sense from the alkoxylated alcohols which also underlie the alkyl ether sulfates) in which terminal ether sulfonates (n-ether sulfonates) with sulfonate function bonded to the polyether chain and internal ether sulfonates (i-ether sulfonates) with sulfonate function joined to the alkyl radical.

Preference is given in accordance with the invention to the alkanesulfonates, in particular alkanesulfonates having a branched, preferably secondary, alkyl radical, for example the secondary alkanesulfonate sodium sec-$C_{13-17}$-alkanesulfonate (INCI Sodium C14-17 Alkyl Sec Sulfonate).

Arylsulfonates used with preference are alkylbenzenesulfonates in which the alkyl radicals are branched and unbranched chains having $C_1$-$C_{20}$, preferably $C_2$-$C_{18}$, more preferably $C_6$-$C_{16}$ and most preferably $C_8$-$C_{12}$. Particularly preferred examples in this context are LAS and/or cumenesulfonate.

The inventive product may comprise one or more alkyl- and/or arylsulfonates in an amount of typically from 0.1 to less than 40% by weight, preferably from 0.1 to 30% by weight, in particular from 1 to less than 14% by weight, more preferably from 2 to 10% by weight, exceptionally preferably from 4 to 8% by weight.

Alkyl Sulfates

In the present invention, alkyl sulfates, for example fatty alcohol sulfates, may also be used. Suitable alkyl sulfates are sulfates of saturated and unsaturated fatty alcohols having $C_6$-$C_{22}$, preferably $C_{10}$-$C_{18}$ and more preferably $C_{11}$-$C_{16}$. Particularly suitable alkyl sulfates are those having a native $C_{12\text{-}14\text{-}16}$ cut and/or petrochemical $C_{12\text{-}13}$, $C_{14\text{-}15}$ cut in the range from 0 to 15%, preferably 0-10%, more preferably 0-8%.

Further Anionic Surfactants

The inventive product may additionally comprise one or more further anionic surfactants, typically in an amount of from 0.001 to 5% by weight, preferably from 0.01 to 4% by weight, in particular from 0.1 to 3% by weight, more preferably from 0.2 to 2% by weight, exceptionally preferably from 0.5 to 1.5% by weight, for example 1% by weight.

Suitable further anionic surfactants are in particular aliphatic sulfates such as monoglyceride sulfates and ester sulfonates (sulfo fatty acid esters), lignosulfonates, fatty acid cyanamides, anionic sulfo-succinic acid surfactants, fatty acid isethionates, acylaminoalkanesulfonates (fatty acid taurides), fatty acid sarcosinates, ether carboxylic acids and alkyl (ether) phosphates.

Suitable further anionic surfactants are also anionic Gemini surfactants having a basic diphenyl oxide structure, 2 sulfonate groups and an alkyl radical on one or both benzene rings according to the formula $^{-}O_3S(C_6H_3R)O(C_6H_3R')SO_3^{-}$ in which R is an alkyl radical having, for example, 6, 10, 12 or 16 carbon atoms, and R' is R or H, (Dowfax® Dry Hydrotrope Powder with $C_{16}$-alkyl radical(s); INCI Sodium Hexyldiphenyl Ether Sulfonate, Disodium Decyl Phenyl Ether Disulfonate, Disodium Lauryl Phenyl Ether Disulfonate, Disodium Cetyl Phenyl Ether Disulfonate) and fluorinated anionic surfactants, in particular perfluorinated alkylsulfonates such as ammonium $C_{9/10}$-perfluoroalkylsulfonate (Fluorad® FC 120) and perfluorooctanesulfonic acid potassium salt (Fluorad® FC 95).

Anionic Sulfosuccinic Acid Surfactants

Particularly preferred further anionic surfactants are the anionic sulfosuccinic acid surfactants, sulfosuccinates, sulfosuccinamates and sulfosuccinamides, in particular sulfosuccinates and sulfosuccinamates, exceptionally preferably sulfosuccinates. The sulfosuccinates are the salts of the mono- and diesters of sulfosuccinic acid $HOOCCH(SO_3H)CH_2COOH$, while the sulfosuccinamates refer to the salts of monoamides of sulfosuccinic acid and the sulfosuccinamides to the salts of diamides of sulfosuccinic acid. A comprehensive description of these known anionic surfactants is provided by A. Domsch and B. Irrgang in *Anionic surfactants: organic chemistry* (edited. by H. W. Stache; Surfactant science series; volume 56; ISBN 0-8247-9394-3; Marcel Dekker, Inc., New York 1996, p. 501-549).

The salts are preferably alkali metal salts, ammonium salts and also mono-, di- and trialkanolammonium salts, for example mono-, di- and triethanolammonium salts, in particular lithium, sodium, potassium or ammonium salts, more preferably sodium or ammonium salts, exceptionally preferably sodium salts.

In the sulfosuccinates, one or both carboxyl groups of sulfosuccinic acid has/have preferably been esterified with one or two identical or different, unbranched or branched, saturated or unsaturated, acyclic or cyclic, optionally alkoxylated alcohols having from 4 to 22, preferably from 6 to 20, in particular from 8 to 18, more preferably from 10 to 16, exceptionally preferably from 12 to 14, carbon atoms. Particular preference is given to the esters of unbranched and/or saturated and/or acyclic and/or alkoxylated alcohols, in particular unbranched, saturated fatty alcohols and/or unbranched, saturated fatty alcohols alkoxylated with ethylene oxide and/or propylene oxide, preferably ethylene oxide, and having a degree of alkoxylation of from 1 to 20, preferably from 1 to 15, in particular from 1 to 10, more preferably from 1 to 6, exceptionally preferably from 1 to 4. In the context of the present invention, the monoesters are preferred over the diesters. A particularly preferred sulfosuccinate is sulfosuccinic acid lauryl polyglycol ester disodium salt (lauryl-EO sulfosuccinate, disodium salt; INCI Disodium Laureth Sulfosuccinate), which is commercially available; for example, as Tego® Sulfosuccinat F 30 (Goldschmidt) having a sulfosuccinate content of 30% by weight.

In the sulfosuccinamates or sulfosuccinamides, one or both carboxyl groups of sulfosuccinic acid preferably form(s) a carboxamide with a primary or secondary amine which bears one or two identical or different, unbranched or branched, saturated or unsaturated, acyclic or cyclic, optionally alkoxylated alkyl radicals having from 4 to 22, preferably from 6 to 20, in particular from 8 to 18, more preferably from 10 to 16, exceptionally preferably from 12 to 14, carbon atoms. Particular preference is given to unbranched and/or saturated and/or acyclic alkyl radicals, in particular unbranched, saturated fatty alkyl radicals.

Also suitable are, for example, the following sulfosuccinates and sulfosuccinamates designated according to INCI, which are described in detail in *International Cosmetic Ingredient Dictionary and Handbook*: Ammonium Dinonyl Sulfosuccinate, Ammonium Lauryl Sulfosuccinate, Diammonium Dimethicone Copolyol Sulfosuccinate, Diammonium Lauramido-MEA Sulfosuccinate, Diammonium Lauryl Sulfosuccinate, Diammonium Oleamido PEG-2 Sulfosuccinate, Diamyl Sodium Sulfosuccinate, Dicapryl Sodium Sulfosuccinate, Dicyclohexyl Sodium Sulfosuccinate, Diheptyl Sodium Sulfosuccinate, Dihexyl Sodium Sulfosuccinate, Diisobutyl Sodium Sulfosuccinate, Dioctyl Sodium Sulfosuccinate, Disodium Cetearyl Sulfosuccinate, Disodium Cocamido MEA-Sulfosuccinate, Disodium Cocamido MIPA-Sulfosuccinate, Disodium Cocamido PEG-3 Sulfosuccinate, Disodium Coco-Glucoside Sulfosuccinate, Disodium Cocoyl Butyl Gluceth-10 Sulfosuccinate, Disodium C12-15 Pareth Sulfosuccinate, Disodium Deceth-5 Sulfosuccinate, Disodium Deceth-6 Sulfosuccinate, Disodium Dihydroxyethyl Sulfosuccinyiundecylehate, Disodium Dimethicone Copolyol Sulfosuccinate, Disodium Hydrogenated Cottonseed Glyceride Sulfosuccinate, Disodium Isodecyl Sulfosuccinate, Disodium Isostearamido MEA-Sulfosuccinate, Disodium Isostearamido, MIPA-Sulfosuccinate, Disodium Isostearyl Sulfosuccinate, Disodium Laneth-5 Sulfosuccinate, Disodium Lauramido MEA-Sulfosuccinate, Disodium Lauramido PEG-2 Sulfosuccinate, Disodium Lauramido PEG-5 Sulfosuccinate, Disodium Laureth-6 Sulfosuccinate, Disodium Laureth-9 Sulfosuccinate, Disodium Laureth-12 Sulfosuccinate, Disodium Lauryl Sulfosuccinate, Disodium Myristamido MEA-Sulfosuccinate, Disodium Nonoxynol-10 Sulfosuccinate, Disodium Oleamido MEA-Sulfosuccinate, Disodium Oleamido MIPA-Sulfosuccinate, Disodium Oleamido PEG-2 Sulfosuccinate, Disodium Oleth-3 Sulfosuccinate, Disodium Oleyl Sulfosuccinate, Disodium Palmitamido PEG-2 Sulfosuccinate, Disodium Palmitoleamido PEG-2 Sulfosuccinate, Disodium PEG-4

Cocamido MIPA-Sulfosuccinate, Disodium PEG-5 Laurylcitrate Sulfosuccinate, Disodium PEG-8 Palm Glycerides Sulfosuccinate, Disodium Ricinoleamido MEA-Sulfosuccinate, Disodium Sitostereth-14 Sulfosuccinate, Disodium Stearamido MEA-Sulfosuccinate, Disodium Stearyl Sulfosuccinamate, Disodium Stearyl Sulfosuccinate, Disodium Tallamido MEA-Sulfosuccinate, Disodium Tallowamido MEA-Sulfosuccinate, Disodium Tallow Sulfosuccinamate, Disodium Tridecylsulfosuccinate, Disodium Undecylenamido MEA-Sulfosuccinate, Disodium Undecylenamido PEG-2 Sulfosuccinate, Disodium Wheat Germamido MEA-Sulfosuccinate, Disodium Wheat Germamido PEG-2 Sulfosuccinate, Di-TEA-Oleamido PEG-2 Sulfosuccinate, Ditridecyl Sodium Sulfosuccinate, Sodium Bisglycol Ricinosulfosuccinate, Sodium/MEA Laureth-2 Sulfosuccinate and Tetrasodium Dicarboxyethyl Stearyl Sulfosuccinamate. Yet another suitable sulfosuccinamate is disodium $C_{16-18}$-alkoxypropylene sulfosuccinamate.

Preferred anionic sulfosuccinic acid surfactants are imidosuccinate, monosodium diisobutyl sulfosuccinate (Monawet® MB 45), monosodium dioctyl sulfosuccinate (Monawete® MO-84 R2W, Rewopol® SB DO 75), monosodium ditridecyl sulfosuccinate (Monawet® MT 70), fatty alcohol polyglycol sulfosuccinate sodium ammonium salt (Sulfosuccinat S-2), disodium mono-$C_{12/14}$-3EO sulfosuccinate (Texapon® SB-3), sodium sulfosuccinate diisooctyl (Texin® DOS 75) and disodium mono-$C_{12/18}$ sulfosuccinate (Texin® 128-P), in particular the monosodium salt of dioctyl sulfosuccinate which interacts synergistically with the inventive ternary surfactant combination with regard to the runoff and/or drying performance.

In a particular embodiment, the inventive product comprises, as anionic sulfosuccinic acid surfactants, one or more sulfosuccinates, sulfosuccinamates and/or sulfosuccinamides, preferably sulfosuccinates and/or sulfosuccinamates, in particular sulfosuccinates, in an amount of typically from 0.001 to 5% by weight, preferably from 0.01 to 4% by weight, in particular from 0.1 to 3% by weight, more preferably from 0.2 to 2% by weight, exceptionally preferably from 0.5 to 1.5% by weight, for example 1% by weight.

Amphoteric Surfactants

The amphoteric surfactants (zwitterionic surfactants) which can be used in accordance with the invention include betaines, alkylamidoalkylamines, alkyl-substituted amino acids, acylated amino acids or biosurfactants, of which preference is given to the betaines in the context of the inventive teaching.

The inventive product may comprise one or more amphoteric surfactants in an amount of typically from 0.1 to 20% by weight, preferably from 1 to 15% by weight, in particular from 2 to 12% by weight, more preferably from 3 to 10% by weight, exceptionally preferably from 4 to 8% by weight.

Betaines

Suitable betaines are the alkylbetaines, the alkylamidobetaines, the imidazoliniumbetaines, the sulfobetaines (INCI Sultaines) and the phosphobetaines and preferably satisfy formula I $$R^1—[CO—X—(CH_2)_n]_x—N^+(R^2)(R^3)—(CH_2)_m—[CH(OH)—CH_2]_y—Y^- \quad (I)$$

in which $R^1$ is a saturated or unsaturated $C_{6-22}$-alkyl radical, preferably $C_8$-$C_{18}$-alkyl radical, in particular a saturated $C_{10-16}$-alkyl radical, for example a saturated $C_{12-14}$-alkyl radical, X is NH, $NR^4$ with the $C_{1-4}$-alkyl radical $R^4$, O or S, n is a number from 1 to 10, preferably from 2 to 5, in particular 3, x is 0 or 1, preferably 1, $R^2$, $R^3$ are each independently $C_{1-4}$-alkyl radicals, optionally hydroxyl-substituted, for example a hydroxyethyl radical, but in particular a methyl radical, m is a number from 1 to 4, in particular 1, 2 or 3, y is 0 or 1 and Y is COO, $SO_3$, $OPO(OR^5)O$ or $P(O)(OR^5)O$, where $R^5$ is a hydrogen atom H or a $C_{1-4}$-alkyl radical.

The alkyl- and alkylamidobetaines, betaines of the formula I having a carboxylate group ($Y^-$=$COO^-$), are also called carbobetaines.

Preferred amphoteric surfactants are the alkylbetaines of the formula (Ia), the alkylamidobetaines of the formula (Ib), the sulfobetaines of the formula (Ic) and the amidosulfobetaines of the formula (Id), $$R^1—N^+(CH_3)_2—CH_2COO^- \quad (Ia)$$

$$R^1—CO—NH—(CH_2)_3—N^+(CH_3)_2—CH_2COO^- \quad (Ib)$$

$$R^1—N^+(CH_3)_2—CH_2CH(OH)CH_2SO_3^- \quad (Ic)$$

$$R^1—CO—NH—(CH_2)_3-N^+(CH_3)_2—CH_2CH(OH)CH_2SO_3^- \quad (Id)$$

in which $R^1$ is as defined in formula I.

Particularly preferred amphoteric surfactants are the carbobetaines, in particular the carbobetaines of the formula (Ia) and (Ib), preferably the alkylamidobetaines of the formula (Ib).

Examples of suitable betaines and sulfobetaines are the following compounds named in accordance with INCI: Almondamidopropyl Betaine, Apricotamidopropyl Betaine, Avocadamidopropyl Betaine, Babassuamidopropyl Betaine, Behenamidopropyl Betaine, Behenyl Betaine, Betaine, Canolamidopropyl Betaine, Capryl/Capramidopropyl Betaine, Carnitine, Cetyl Betaine, Cocamidoethyl Betaine, Cocamidopropyl Betaine, Cocamidopropyl Hydroxysultaine, Coco-Betaine, Coco-Hydroxysultaine, Coco/Oleamidopropyl Betaine, Coco-Sultaine, Decyl Betaine, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl PG-Betaine, Erucamidopropyl Hydroxysultaine, Hydrogenated Tallow Betaine, Isostearamidopropyl Betaine, Lauramidopropyl Betaine, Lauryl Betaine, Lauryl Hydroxysultaine, Lauryl Sultaine, Milkamidopropyl Betaine, Minkamidopropyl Betaine, Myristamidopropyl Betaine, Myristyl Betaine, Oleamidopropyl Betaine, Oleamidopropyl Hydroxysultaine, Oleyl Betaine, Olivamidopropyl Betaine, Palmamidopropyl Betaine, Palmitamidopropyl Betaine, Palmitoyl Carnitine, Palm Kernelamidopropyl Betaine, Polytetrafluoroethylene Acetoxypropyl Betaine, Ricinoleamidopropyl Betaine, Sesamidopropyl Betaine, Soyamidoprbpyl Betaine, Stearamidopropyl Betaine, Stearyl Betaine, Tallowamidopropyl Betaine, Tallowamidopropyl Hydroxysultaine, Tallow Betaine, Tallow Dihydroxyethyl Betaine, Undecylenamidopropyl Betaine and Wheat Germamidopropyl Betaine. A preferred betaine is, for example, Cocamidopropyl Betaine (cocamidopropyl-betaine).

Alkylamidoalkylamines

The alkylamidoalkylamines (INCI Alkylamido Alkylamines) are amphoteric surfactants of the formula (III)

$$R^9—CO—NR^{10}—(CH_2)_i—N(R^{11})—(CH_2CH_2O)_j—(CH_2)_k—[CH(OH)]_l—CH_2\text{-}Z\text{-}OM \quad (III)$$

in which $R^9$ is a saturated or unsaturated $C_{6-22}$-alkyl radical, preferably $C_{8-18}$-alkyl radical, in particular a saturated $C_{10-16}$-alkyl radical, for example a saturated $C_{12-14}$-alkyl radical, $R^{10}$ is a hydrogen atom H or a $C_{1-4}$-alkyl radical, preferably H, i is a number from 1 to 10, preferably from 2 to 5, in particular 2 or 3, $R^{11}$ is a hydrogen atom H or $CH_2COOM$ (for M see below), j is a number from 1 to 4, preferably 1 or 2, in particular 1, k is a number from 0 to 4, preferably 0 or 1, l is 0 or 1, where k=1 when l=1, Z is CO, $SO_2$, $OPO(OR^{12})$ or $P(O)(OR^{12})$, where $R^{12}$ is a $C_{1-4}$-alkyl radical or M (see below), and M is hydrogen, an alkali metal, an alkaline earth metal or a protonated alkanolamine, e.g. protonated mono-, di- or triethanolamine.

Preferred representatives satisfy the formulae IIIa to IIId $$R^9—CO—NH—(CH_2)_2—N(R^{11})—CH_2CH_2O—CH_2—COOM \quad (IIIa)$$

$$R^9—CO—NH—(CH_2)_2—N(R^{11})—CH_2CH_2O—CH_2CH_2—COOM \quad (IIIb)$$

$$R^9—CO—NH—(CH_2)_2—N(R^{11})—CH_2CH_2—CH_2CH(OH)CH_2—SO_3M \quad (IIIc)$$

$$R^9—CO—NH—(CH_2)_2—N(R^{11})—CH_2CH_2O—CH_2CH(OH)CH_2—OPO_3HM \quad (IIID)$$

in which $R^{11}$ and M are each as defined in formula (III).

Examples of alkylamidoalkylamines are the following compounds named in accordance with INCI: Cocoamphodipropionic Acid, Cocobetainamido Amphopropionate, DEA-Cocoamphodipropionate, Disodium Caproamphodiacetate, Disodium Caproamphodipropionate, Disodium Capryloamphodiacetate, Disodium Capryloamphodipriopionate, Disodium Cocoamphocarboxyethylhydroxypropylsulfonate, Disodium Cocoamphodiacetate, Disodium Cocoamphodipropionate, Disodium Isostearoamphodiacetate, Disodium Isostearoamphodipropionate, Disodium Laureth-5 Carboxyamphodiacetate, Disodium Lauroamphodiacetate, Disodium Lauroamphodipropionate, Disodium Oleoamphodipropionate, Disodium PPG-2-Isodeceth-7 Carboxyamphodiacetate, Disodium Stearoamphodiacetate, Disodium Tallowamphodiacetate, Disodium Wheatgermamphodiacetate, Lauroamphodipropionic Acid, Quaternium-85, Sodium Caproamphoacetate, Sodium Caproamphohydroxypropylsulfonate, Sodium Caproampho-propionate, Sodium Capryloamphoacetate, Sodium Capryloamphohydroxypropylsulfonate, Sodium Capryloamphopropionate, Sodium Cocoamphoacetate, Sodium Cocoamphohydroxypropylsulfonate, Sodium Cocoamphopropionate, Sodium Cornamphopropionate, Sodium Isostearoamphoacetate, Sodium Isostearoamphopropionate, Sodium Lauroamphoacetate, Sodium Lauroamphohydroxypropylsulfonate, Sodium Lauroampho PG-Acetate Phosphate, Sodium Lauroamphopropionate, Sodium Myristoamphoacetate, Sodium Oleoamphoacetate, Sodium Oleoamphohydroxypropylsulfonate, Sodium Oleoamphopropionate, Sodium Ricinoleoamphoacetate, Sodium Stearoamphoacetate, Sodium Stearoamphohydroxypropylsulfonate, Sodium Stearoamphopropionate, Sodium Tallamphopropionate, Sodium Tallowamphoacetate, Sodium Undecylenoamphoacetate, Sodium Undecylenoamphopropionate, Sodium Wheat Germamphoacetate and Trisodium Lauroampho PG-Acetate Chloride Phosphate.

Alkyl-Substituted Amino Acids

Alkyl-substituted amino acids (INCI Alkyl-Substituted Amino Acids) preferred in accordance with the invention are monoalkyl-substituted amino acids of formula (IV)

$$R^{13}—NH—CH(R^{14})—(CH_2)_u—COOM' \quad (IV)$$

in which $R^{13}$ is a saturated or unsaturated $C_{6-22}$-alkyl radical, preferably $C_{8-18}$-alkyl radical, in particular a saturated $C_{10-16}$-alkyl radical, for example a saturated $C_{12-14}$-alkyl radical, $R^{14}$ is a hydrogen atom H or a $C_{1-4}$-alkyl radical, preferably H, u is a number from 0 to 4, preferably 0 or 1, in particular 1, and M' is hydrogen, an alkali metal, an alkaline earth metal or a protonated alkanolamine, e.g. protonated mono-, di- or triethanolamine, alkyl-substituted imino acids of formula (V)

$$R^{15}—N—[(CH_2)_v—COOM'']_2 \quad (V)$$

in which $R^{15}$ is a saturated or unsaturated $C_{6-22}$-alkyl radical, preferably $C_{8-18}$-alkyl radical, in particular a saturated $C_{10-16}$-alkyl radical, for example a saturated $C_{12-14}$-alkyl radical, v is a number from 1 to 5, preferably 2 or 3, in particular 2, and M'' is hydrogen, an alkali metal, an alkaline earth metal or a protonated alkanolamine, e.g. protonated mono-, di- or triethanolamine, where M'' in the two carboxyl groups may have the same or two different definitions, for example may be hydrogen and sodium, or sodium twice, and monoalkyl- or dialkyl-substituted natural amino acids of formula (VI)

$$R^{16}—N(R^{17})—CH(R^{18})—COOM''' \quad (VI)$$

in which $R^{16}$ is a saturated or unsaturated $C_{6-22}$-alkyl radical, preferably $C_{8-18}$-alkyl radical, in particular a saturated $C_{10-16}$-alkyl radical, for example a saturated $C_{12-14}$-alkyl radical, $R^{17}$ is a hydrogen atom or a $C_{1-4}$-alkyl radical, optionally hydroxy- or amine-substituted, e.g. a methyl, ethyl, hydroxyethyl or aminopropyl radical, $R^{18}$ is the radical of one of the 20 natural α-amino acids $H_2NCH(R^{18})COOH$, and M''' is hydrogen, an alkali metal, an alkaline earth metal or a protonated alkanolamine, e.g. protonated mono-, di- or triethanolamine.

Particularly preferred alkyl-substituted amino acids are the aminopropionates according to formula, (IVa)

$$R^{13}—NH—CH_2CH_2COOM' \quad (IVa)$$

in which $R^{13}$ and M' are each as defined in formula (IV).

Examples of alkyl-substituted amino acids are the following compounds named in accordance with INCI: Aminopropyl Laurylglutamine, Cocaminobutyric Acid, Cocaminopropionic Acid, DEA-Lauraminopropionate, Disodium Cocaminopropyl Iminodiacetate, Disodium Dicarboxyethyl Cocopropylenediamine, Disodium Lauriminodipropionate, Disodium Steariminodipropionate, Disodium Tallowiminodipropionate, Lauraminopropionic Acid, Lauryl Aminopropylglycine, Lauryl Diethylenediaminoglycine, Myristaminopropionic Acid, Sodium C12-15 Alkoxypropyl Iminodipropionate, Sodium Cocaminopropionate, Sodium Lauraminopropionate, Sodium Lauriminodipropionate, Sodium Lauroyl Methylaminopropionate, TEA-Lauraminopropionate and TEA-Myristaminopropionate.

Acylated Amino Acids

Acylated amino acids are amino acids, in particular the 20 natural α-amino acids which bear the acyl radical $R^{19}CO$ of a saturated or unsaturated fatty acid $R^{19}COOH$ on the amino nitrogen atom where $R^{19}$ is a saturated or unsaturated $C_{6-22}$-alkyl radical, preferably $C_{8-18}$-alkyl radical, in particular a saturated $C_{10-16}$-alkyl radical, for example a saturated $C_{12-14}$-alkyl radical. The acylated amino acids may also be used as alkali metal salt, alkaline earth metal salt or alkanolammonium salt, e.g. mono-, di- or triethanolammonium salt. Examples of acylated amino acids are the acyl derivatives grouped under Amino Acids in accordance with INCI, e.g. Sodium Cocoyl Glutamate, Lauroyl Glutamic Acid, Capryloyl Glycine or Myristoyl Methylalanine.

It is particularly advantageous to use a combination of anionic surfactant and amphoteric surfactant. This combination firstly brings about a particularly good cleaning action and can additionally secondly, in conjunction with the thickener used, make a contribution to a spatially very stable suspension of the abrasive particles.

Nonionic Surfactants

The inventive product may additionally comprise one or more nonionic surfactants, typically in an amount of from 0.001 to 5% by weight, preferably from 0.01 to 4% by weight, in particular from 0.1 to 3% by weight, more preferably from 0.2 to 2% by weight, exceptionally preferably from 0.5 to 1.5% by weight, for example 1% by weight.

In the context of the invention, nonionic surfactants may be alkoxylates such as polyglycol ethers, fatty alcohol polyglycol ethers, alkylphenol polyglycol ethers, end group-capped polyglycol ethers, mixed ethers and hydroxy mixed ethers and fatty acid polyglycol esters. It is likewise possible to use ethylene oxide-propylene oxide block polymers, fatty acid alkanolamides and fatty acid polyglycol ethers. Important classes of nonionic surfactants which can be used in accordance with the invention are also the amine oxides and the sugar surfactants (polyol surfactants) and, among these, particularly the glyco-surfactants such as alkylpolyglycosides and fatty acid glucamides. Particular preference is given to the alkylpolyglycosides, especially the alkylpolyglucosides.

Fatty Alcohol Polyglycol Ethers

According to the invention, fatty alcohol polyglycol ethers refer to unbranched or branched, saturated or unsaturated $C_{10-22}$ alcohols which have been alkoxylated with ethylene oxide (EO) and/or propylene oxide (PO) and have a degree of alkoxylation of up to 30, preferably ethoxylated $C_{10-18}$ fatty alcohols having a degree of ethoxylation of up to 30, preferably having a degree of ethoxylation of from 1 to 20, in particular of from 1 to 12, more preferably of from 1 to 8, exceptionally preferably of from 2 to 5, for example $C_{12-14}$-fatty alcohol ethoxylates having 2, 3 or 4 EO or a mixture of the $C_{12-14}$-fatty alcohol ethoxylates with 3 and 4 EO in a weight ratio of 1 to 1 or isotridecyl alcohol ethoxylate having 5, 8 or 12 EO.

Amine Oxides

The amine oxides suitable in accordance with the invention include alkylamine oxides, in particular alkyldimethylamine oxides, alkylamido amine oxides and alkoxyalkyl amine oxides. Preferred amine oxides satisfy formula II $$R^6R^7R^8N^+—O^- \quad (II)$$

$$R^6—[CO—NH—(CH_2)_w]_z—N^+(R^7)(R^8)—O^- \quad (II)$$

in which $R^6$ is a saturated or unsaturated $C_{6-22}$-alkyl radical, preferably $C_{8-18}$-alkyl radical, in particular a saturated $C_{10-16}$-alkyl radical, for example a saturated $C_{12-14}$-alkyl radical which is bonded to the nitrogen atom N via a carbonylamido alkylene group —CO—NH—$(CH_2)_z$— in the alkylamido amine oxides and via an oxaalkylene group —O—$(CH_2)_z$— in the alkoxyalkyl amine oxides, where z is in each case a number from 1 to 10, preferably from 2 to 5, in particular 3, $R^7$, $R^8$ are each independently a $C_{1-4}$-alkyl radical, optionally hydroxyl-substituted, for example a hydroxyethyl radical, in particular a methyl radical.

Examples of suitable amine oxides are the following compounds named in accordance with INCI: Almondamidopropylamine Oxide, Babassuamidopropylamine Oxide, Behenamine Oxide, Cocamidopropyl Amine Oxide, Cocamidopropylamine Oxide, Cocamine Oxide, Coco-Morpholine Oxide, Decylamine Oxide, Decyltetradecylamine Oxide, Diaminopyrimidine Oxide, Dihydroxyethyl C8-10 Alkoxypropylamine Oxide, Dihydroxyethyl C9-11 Alkoxypropylamine Oxide, Dihydroxyethyl C12-15 Alkoxypropylamine Oxide, Dihydroxyethyl Cocamine Oxide, Dihydroxyethyl Lauramine Oxide, Dihydroxyethyl Stearamine Oxide, Dihydroxyethyl Tallowamine Oxide, Hydrogenated Palm Kernel Amine Oxide, Hydrogenated Tallowamine Oxide, Hydroxyethyl Hydroxypropyl C12-15 Alkoxypropylamine Oxide, Isostearamidopropylamine Oxide, Isostearamidopropyl Morpholine Oxide, Lauramidopropylamine Oxide, Lauramine Oxide, Methyl Morpholine Oxide, Milkamidopropyl Amine Oxide, Minkamidopropylamine Oxide, Myristamidopropylamine Oxide, Myristamine Oxide, Myristyl/Cetyl Amine Oxide, Oleamidopropylamine Oxide, Oleamine Oxide, Olivamidopropylamine Oxide, Palmitamidopropylamine Oxide, Palmitamine Oxide, PEG-3 Lauramine Oxide, Potassium Dihydroxyethyl Cocamine Oxide Phosphate, Potassium Trisphosphonomethylamine Oxide, Sesamidopropylamine Oxide, Soyamidopropylamine Oxide, Stearamidopropylamine Oxide, Stearamine Oxide, Tallowamidopropylamine Oxide, Tallowamine Oxide, Undecylenamidopropylamine Oxide and Wheat Germamidopropylamine Oxide. A preferred amine oxide is, for example, Cocamidopropylamine Oxide.

Sugar Surfactants

Sugar surfactants are known surface-active compounds which include, for example, the sugar surfactant classes of the alkylglucose esters, aldobionamides, gluconamides (sugar acid amides), glyceramides, glyceroglycolipids, polyhydroxy fatty acid amide sugar surfactants (sugar amides) and alkylpolyglycosides, as described, for instance, in WO 97/00609 (Henkel Corporation) and the documents cited therein (pages 4 to 12), to which reference is made in this regard and whose contents are incorporated into this application. In the context of the inventive teaching, preferred sugar surfactants are the alkylpolyglycosides and the sugar amides and also derivatives thereof, in particular their ethers and esters. The ethers are the products of the reaction of one or more sugar hydroxyl groups, preferably one sugar hydroxyl group, with a compound containing one or more hydroxyl groups, for example $C_{1-22}$-alcohols or glycols such as ethylene glycol and/or propylene glycol, and the sugar hydroxyl group may also bear polyethylene glycol and/or polypropylene glycol radicals. The esters are the reaction products of one or more, preferably one, sugar hydroxyl group with a carboxylic acid, in particular a $C_{6-22}$ fatty acid.

Sugar Amides

Particularly preferred sugar amides satisfy the formula R'C(O)N(R")[Z] in which R' is a linear or branched, saturated or unsaturated acyl radical, preferably a linear, unsaturated acyl radical having from 5 to 21, preferably from 5 to 17, in particular from 7 to 15, more preferably from 7 to 13, carbon atoms, R" is a linear or branched, saturated or unsaturated alkyl radical, preferably a linear, unsaturated alkyl radical having from 6 to 22, preferably from 6 to 18, in particular from 8 to 16, more preferably from 8 to 14, carbon atoms, a $C_{1-5}$-alkyl radical, in particular a methyl, ethyl, propyl, isopropyl, n-butyl, isobutyl, tert-butyl or n-pentyl radical, or hydrogen, and Z is a sugar residue, i.e. a monosaccharide residue. Particularly preferred sugar amides are the amides of glucose, the glucamides, for example lauroyl methyl glucamide.

Alkylpolyglycosides

Alkylpolyglycosides (APG) are also particularly preferred sugar surfactants in the context of the inventive teaching and preferably satisfy the general formula $R^1O(AO)_a[G]_x$ in which R is a linear or branched, saturated or unsaturated alkyl radical having from 6 to 22, preferably from 6 to 18, in particular from 8 to 16, more preferably from 8 to 14, carbon atoms, [G] is a glycoside-attached sugar residue and x is a number from 1 to 10 and AO is an alkyleneoxy group, for example an ethyleneoxy or propyleneoxy group, and a is the average degree of alkoxylation of from 0 to 20. The $(AO)_a$ group may also contain different alkyleneoxy units, for example ethyleneoxy or propyleneoxy units, in which case a is then the average total degree of alkoxylation, i.e. the sum of degree of ethoxylation and degree of propoxylation. Unless stated in more detail or otherwise hereinbelow, the alkyl radicals $R^1$ of the APG are linear unsaturated radicals having the specified number of carbon atoms.

APGs are nonionic surfactants and constitute known substances which can be obtained by the relevant preparative organic chemistry methods. The index number x specifies the degree of oligomerization (average degree of polymerization), i.e. the distribution of mono- and oligoglycosides, and is a number between 1 and 10. While x in a given compound always has to be an integer and here in particular may assume the values x=from 1 to 6, the x value for a certain alkylglycoside is an, analytically determined calculated parameter which is usually a fraction. Preference is given to using alkylglycosides having an average degree of oligomerization x of from 1.1 to 3.0. From an application point of view, preference is given to those alkylglycosides whose degree of oligomerization is less than 1.7 and is in particular between 1.2 and 1.6. The glycosidic sugars used are preferably xylose, but in particular glucose.

The alkyl or alkenyl radical $R^1$ may derive from primary alcohols having from 8 to 18, preferably from 8 to 14, carbon atoms. Typical examples are caproic alcohol, caprylic alcohol, capric alcohol and undecyl alcohol and also their technical-grade mixtures, as obtained, for example, in the course of the hydrogenation of technical-grade fatty acid methyl esters or in the course of the hydrogenation of aldehydes from the ROELEN oxo process.

However, the alkyl or alkenyl radical $R^1$ preferably derives from lauryl alcohol, myristyl alcohol, cetyl alcohol, palmoleyl alcohol, stearyl alcohol, isostearyl alcohol or oleyl alcohol. Mention should also be made of elaidyl alcohol, petroselinyl aloohol, arachidyl alcohol, gadoleyl alcohol, behenyl alcohol, erucyl alcohol and their technical-grade mixtures.

Particularly preferred APGs are not alkoxylated (a=0) and satisfy formula $RO[G]_x$ in which R, as before, is a linear or branched, saturated or unsaturated alkyl radical having from 4 to 22 carbon atoms, [G] is a glycoside-attached sugar radical, preferably glucose radical, and x is a number from 1 to 10, preferably from 1.1 to 3, in particular from 1.2 to 1.6. Accordingly, preferred alkylpolyglycosides are, for example, $C_{8-10}$- and a $C_{12-14}$-alkylpolyglucoside having an average degree of polymerization of 1.4 or 1.5, in particular $C_{8-10}$-alkyl 1,5-glucoside and $C_{12-14}$-alkyl 1,4-glucoside.

Cationic Surfactants

The inventive product may additionally comprise one or more cationic surfactants (INCI Quaternary Ammonium Compounds), typically in an amount of from 0.001 to 5% by weight, preferably from 0.01 to 4% by weight, in particular from 0.1 to 3% by weight, more preferably from 0.2 to 2% by weight, exceptionally preferably from 0.5 to 1.5% by weight, for example 1% by weight. However, in a preferred embodiment, the use of cationic surfactants is dispensed with.

Preferred cationic surfactants are the quaternary surface-active compounds, especially having an ammonium, sulfonium, phosphonium, iodinium or arsonium group, which are antimicrobial substances as described, for example, by K. H. Wallhäusser in "Praxis der Sterilisation, Desinfektion—Konservierung: Keimidentifizierung—Betriebshygiene" [Practice of Sterilization, Disinfection—Preservation: Germ Identification—Workplace Hygiene] ($5^{th}$ ed.—Stuttgart; New York: Thieme, 1995). The use of quaternary surface-active compounds having antimicrobial action may equip the composition with antimicrobial action or improve any antimicrobial action already present owing to other ingredients.

In addition to the quaternary ammonium compounds of the formula I used as drying and gloss additives, particularly preferred cationic surfactants are the quaternary, partly antimicrobially active ammonium compounds (QACs; INCI Quaternary Ammonium Compounds) of the general formula $(R^I)(R^{II})(R^{III})(R^{IV})N^+X^-$ in which $R^I$ to $R^{IV}$ are identical or different $C_{1-22}$-alkyl radicals, $C_7$-28-aralkyl radicals or heterocyclic radicals, in which two, or, in the case of an aromatic single bond as in pyridine, even three radicals, together with the nitrogen atom form the heterocycle, for example a pyridinium or imidazolinium compound, and $X^-$ are halide ions, sulfate ions, hydroxide ions or similar anions. For an optimal antimicrobial action, at least one of the radicals preferably has a chain length of from 8 to 18, in particular from 12 to 16, carbon atoms.

QACs can be prepared by reacting tertiary amines with alkylating agents, for example methyl chloride, benzyl chloride, dimethyl sulfate, dodecyl bromide, but also ethylene oxide. The alkylation of tertiary amines having a long alkyl radical and two methyl groups succeeds particularly readily, and the quaternization of tertiary amines having two long radicals and a methyl group may also be carried out with the aid of methyl chloride under mild conditions. Amines which have three long alkyl radicals or hydroxyl-substituted alkyl radicals have low reactivity and are preferably quaternized with dimethyl sulfate.

Suitable QACs are, for example, benzalkonium chloride (N-alkyl-N,N-dimethylbenzylammonium chloride, CAS No. 8001-54-5), benzalkone B (m,p-dichlorobenzyldimethyl-$C_{12}$-alkylammonium chloride, CAS No. 58390-78-6), benzoxonium chloride (benzyldodecylbis(2-hydroxyethyl)ammonium chloride), cetrimonium bromide (N-hexadecyl-N,N-trimethylammonium bromide, CAS No. 57-09-0), benzetonium chloride (N,N-dimethyl-N-[2-[2-[p-(1,1,3,3-tetramethylbutyl)phenoxy]ethoxy]ethyl]benzylammonium chloride, CAS No. 121-54-0), dialkyldimethylammonium chlorides such as di-n-decyldimethylammonium chloride (CAS No. 7173-51-5-5), didecyldimethylammonium bromide (CAS No. 2390-68-3), dioctyldimethylammonium chloride, 1-cetylpyridinium chloride (CAS No. 123-03-5) and thiazoline iodide (CAS No. 15764-48-1) and also mixtures thereof. Preferred QACs are the benzalkonium chlorides having $C_8$-$C_{18}$-alkyl radicals, in particular $C_{12}$-$C_{14}$-alkylbenzyldimethylammonium chloride. A particularly preferred QAC is cocopentaethoxymethylammonium methosulfate (INCI PEG-5 Cocomonium Methosulfate; Rewoquat® CPEM).

To avoid possible incompatibilities of the antimicrobial cationic surfactants with the anionic surfactants present in accordance with the invention, very substantially anionic surfactant-compatible and/or very little cationic surfactant is used, or, in a particular embodiment of the invention, antimicrobially active cationic surfactants are entirely dispensed with. The antimicrobially active substances used may be parabens, benzoic acid and/or benzoate, lactic acid and/or lactates. Particular preference is given to benzoic acid and/or lactic acid.

Solvents

The water content of the inventive aqueous product is typically from 20 to less than 85% by weight, preferably from 30 to 80% by weight.

The inventive product may advantageously additionally comprise one or more water-soluble organic solvents, typically in an amount of from 0.1 to 30% by weight, preferably from 1 to 20% by weight, in particular from 2 to 15%, by weight, more preferably from 4 to 12% by weight, exceptionally preferably from 6 to 10% by weight.

In the context of the inventive teaching, the solvent is used as required in particular as a hydrotrope, viscosity regulator and/or cold stabilizer. It has a solubilizing action especially for surfactants and electrolyte, and also perfume and dye, and thus contributes to their incorporation, prevents the formation of liquid-crystalline phases and contributes to the formation of clear products. The viscosity of the inventive product falls with increasing amount of solvent. However, top much solvent can bring about too great a decrease in viscosity. Ultimately, the cold opacification and clearing point of the inventive product fall with increasing amount of solvent.

Suitable solvents are, for example, saturated or unsaturated, preferably saturated, branched or unbranched $C_{1-20}$ hydrocarbons, preferably $C_{2-15}$ hydrocarbons, having at least one hydroxyl group and optionally one or more ether functions C—O—C, i.e. oxygen atoms which interrupt the carbon atom chain.

Preferred solvents are the $C_{2-6}$-alkylene glycols and poly-$C_{2-3}$-alkylene glycol ethers which have optionally been monoetherified with a $C_{1-6}$-alkanol and have on average from 1 to 9 identical or different, preferably identical, alkylene glycol groups per molecule, and also the $C_{1-6}$ alcohols, preferably ethanol, n-propanol or isopropanol, in particular ethanol.

Examples of solvents are the following compounds named according to INCI: Alcohol (Ethanol), Buteth-3, Butoxydiglycol, Butoxyethanol, Butoxyisopropanol, Butoxypropanol, n-Butyl Alcohol, t-Butyl Alcohol, Butylene Glycol, Butyloctanol, Diethylene Glycol, Dimethoxydiglycol, Dimethyl Ether, Dipropylene Glycol, Ethoxydiglycol, Ethoxyethanol, Ethyl Hexanediol, Glycol, Hexanediol, 1,2,6-Hexanetriol, Hexyl Alcohol, Hexylene Glycol, Isobutoxypropanol, Isopentyldiol, Isopropyl Alcohol (iso-Propanol), 3-Methoxybutanol, Methoxydiglycol, Methoxyethanol, Methoxyisopropanol, Methoxymethylbutanol, Methoxy PEG-10, Methylal, Methyl Alcohol, Methyl Hexyl Ether, Methylpropanediol, Neopentyl Glycol, PEG-4, PEG-6, PEG-7, PEG-8, PEG-9, PEG-6 Methyl Ether, Pentylene Glycol, PPG-7, PPG26, PPG 400, PPG 1200, PPG-2-Buteth-3, PPG-2 Butyl Ether, PPG-3 Butyl Ether, PPG-2 Methyl Ether, PPG-3 Methyl Ether, PPG-2 Propyl Ether, Propanediol, Propyl Alcohol (n-Propanol), Propylene Glycol, Propylene Glycol Butyl Ether, Propylene Glycol Propyl Ether, Tetrahydrofurfuryl Alcohol, Trimethylhexanol.

Particularly preferred solvents are the poly-$C_{2-3}$-alkylene glycol ethers which have been monoetherified with a $C_{1-6}$-alkanol and have on average from 1 to 9, preferably from 2 to 3, ethylene glycol or propylene glycol groups, for example PPG-2 Methyl Ether (dipropylene glycol monomethyl ether).

Exceptionally preferred solvents are the $C_{2-3}$-alcohols ethanol, n-propanol and/or iso-propanol, in particular ethanol.

Solubilizers

Apart from the above-described solvents (in particular the polyils such as ethylene glycol, 1,2-propylene glycol, glycerol and other mono- and polyhydric alcohols), the solubilizers used, for instance for dyes and perfume oils, may, for example, also be alkanolamines and alkylbenzenesulfonates having from 1 to 3 carbon atoms in the alkyl radical.

To stabilize the inventive cleaning product at the high surfactant content in accordance with the invention, one or more dicarboxylic acids and/or salts thereof may be added alone or in a mixture, in particular a composition composed of sodium salts of adipic, succinic and glutaric acid, as obtainable, for example, under the trade name Sokalan® DSC. They are used advantageously in amounts of from 0.1 to 8% by weight, preferably from 0.5, to 7% by weight, in particular from 1.3 to 6% by weight and more preferably from 2 to 4% by weight.

A change in the dicarboxylic acid (salt) content may, especially in amounts above 2% by weight, contribute to a clear solution of the ingredients. An influence on the viscosity of the mixture by this composition is likewise possible within certain limits. This component further influences the solubility of the mixture. This component is used more preferably at high surfactant contents, in particular at surfactant contents above 30% by weight.

Instead of or in addition to the dicarboxylic acids and/or salts thereof, it is also possible to use other organic acids or salts thereof for viscosity regulation, for example sodium formate, sodium acetate, sodium citrate and sodium tartrate, and also inorganic salts, for example sodium chloride, magnesium chloride and magnesium sulfate, or else salts of the aforementioned anions with other alkali metals or alkaline earth metals, individually or in mixtures.

Hydrophobic Polymers

To improve the solubility and for improved control of the viscosity of inventive products, they may also comprise hydrophobic polymers. In the context of this invention, this refers to polyalkylene glycols, i.e. polymeric glycols having alkylene oxide units which are preferably ethylene oxide (EO) and/or propylene oxide (PO). According to the invention, particular preference is given to polypropylene glycols (PPGs) and polyethylene glycols (PEGs) having an average molecular weight of from 400 to 1200, for example PPG 400, PPG 900 or else PPG 1200.

Assistants and Additives

In addition to the components specified, the inventive cleaning products may comprise further assistants and additives, as are customary in such compositions. These include, in particular, UV stabilizers, perfumes, dyes, polymers, soil-release active ingredients, gloss-enhancing substances (for example vinegar, in particular fruit vinegar), hydrotropes (for example cumenesulfonate, octylsulfate, butylglycoside, butylglycol), cleaning enhancers, pH regulators (for example citric acid, alkanolamines or sodium hydroxide), disinfectants, antistats, corrosion inhibitors and/or preservatives, enzymes (in particular lipases, amylases), optical brighteners and skin protection agents as described in EP-A-522 506. The amount of such additives is typically not more than 12% by weight in the cleaning product. The lower limit of use depends upon the type of additive. The amount of assistants is preferably between 0.01 and 7% by weight, in particular 0.1 and 4% by weight.

Viscosity

The viscosity favorable for the inventive products is between 2500 and 100 000 mPa·s at 20° C. and a shear rate of 0.3 rpm, preferably between 3000 and 90 000 mPa·s, or between 1200 and 10 000 mPa·s at 20° C. and a shear rate of 3 rpm, preferably between 1500 and 9000 mPa·s, or between 250 and 2500 mPa·s at 20° C. and a shear rate of 30 rpm, preferably between 300 and 2000 mPa·s (measured with a Brookfield viscometer DV II +, spindle 31, 2 min).

The viscosity of the inventive products can be adjusted by the thickener. The required amounts may be different from thickener to thickener. The surfactant composition used also plays a role in the selection of amount, as does the presence of solubilizers.

pH

The pH of the inventive products may be adjusted by means of customary pH regulators, for example citric acid or NaOH, and preference is given, substantially owing to the required hand compatibility, to a range from 3 to 10, preferably from 4 to 8.

Use

The inventive cleaning product can be used as a manual dishwashing liquid in a customary manner. In addition, it can also be used in concentrated form for the preliminary cleaning of tableware, especially highly soiled tableware, in some cases with burnt-on greasy soil. Finally, the product is also suitable for manual cleaning of hard surfaces, for example of glass, ceramic, plastic, enamel or metal, in the household and industry.

Production

The inventive cleaning products can be produced in all customary ways known to those skilled in the art.

Preferably, either the thickener, optionally preswelled in cold or warm water, is initially charged and the remaining components are subsequently stirred in, or else water, surfactants and any further components present are combined successively and stirred, and subsequently, if they are used, perfume and/or dye are added, and finally the optionally preswelled thickener is stirred in. Subsequently, the pH is adjusted as described above and the abrasive particles are finally mixed in.

EXAMPLES

The inventive manual dishwashing liquids E1to E4 were each formulated with a content of abrasive particles of 1% by weight. The two comparative examples C1 and C2 had the same composition throughout, but they were produced without abrasive. The test of cleaning performance carried out subsequently showed distinct advantages of the inventive products.

TABLE 1

| | Exemplary compositions | | | | | |
|---|---|---|---|---|---|---|
| | E1 | C1 | E2 | C2 | E3 | E4 |
| Na $C_{13-17}$-sec-alkanesulfonate | 4.0 | 4.0 | 7.0 | 7.0 | 4.0 | 7.0 |
| Na $C_{12-14}$ fatty alcohol + 1.3EO sulfate | 8.0 | 8.0 | 14.0 | 14.0 | 8.0 | 14.0 |
| Cocoamidopropylbetaine | 4.0 | 4.0 | 7.0 | 7.0 | 4.0 | 7.0 |
| Xanthan gum | 0.6 | 0.6 | — | — | 0.6 | — |
| Acrylic acid copolymer | — | — | 2.5 | 2.5 | — | 2.5 |
| Polystyrene particles, 0.6-1.0 mm | 1.0 | — | — | — | — | — |
| Polystyrene particles, 1.0-1.6 mm | — | — | 1.0 | — | — | — |
| Walnut shell meal, 0.1-0.2 mm | — | — | — | — | 1.0 | — |
| Polyethylene wax, 0.4-0.5 mm | — | — | — | — | — | 1.0 |
| Perfume | 0.2 | 0.2 | 0.2 | 0.2 | 0.2 | 0.2 |
| Ethanol | — | — | 3.0 | 3.0 | — | 3.0 |
| Preservative, dye | <0.05 | <0.05 | <0.05 | <0.05 | <0.05 | <0.05 |
| Water | ad 100 | ad 100 | ad 100 | ad 100 | ad 100 | ad 100 |

All data in % by weight.

Test of Cleaning Performance

The cleaning performance was determined by means of a modified Gardner test apparatus. To this end, tomato and cheese sauce or gravy as a test soil were spread in a thickness of 450 μm with a doctor blade on a stainless steel plate and burnt on at 120° C. for 1 h. Subsequently, the number of strokes was determined which an automatic wiper unit which was equipped with a cloth saturated with 4 ml of the particular product required to fully remove the test soil. In this context, one stroke means a double movement of the carriage equipped with the cloth comprising the cleaning product over the plate to be cleaned (back and forth). The soil was regarded as having been removed fully when five people in an evaluation agreed that the soil could no longer be seen with the naked eye. The number of strokes reported is additionally the average of three measurements.

The result is reproduced in the following table:

TABLE 2

| | Test of cleaning performance | | | | | |
|---|---|---|---|---|---|---|
| | E1 | C1 | E2 | C2 | E3 | E4 |
| Number of strokes required, concentrated application (cheese and tomato sauce) | 46 | >100 | 55 | >100 | — | — |
| Number of strokes required, concentrated application (gravy) | — | 75 | — | 72 | 15 | 22 |

The results show clearly that, when an inventive cleaning product with abrasive particles is used, full cleaning can be achieved substantially more rapidly than with a conventional, abrasive-free cleaning product.

As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise. All numerical quantities are understood to be modified by the word "about," unless specifically modified otherwise or unless an exact amount is needed to define the invention over the prior art.

What is claimed is:

1. A substantially transparent, liquid cleaning product for hard surfaces, comprising from 0.1 to 20% by weight of an amphoteric surfactant selected from the group consisting of betaines, amine oxides, alkylamidoalkylamines, alkyl-substituted amino acids, acylated amino acids, and any mixtures thereof and one or more abrasive materials comprising polystyrene particles having a diameter of from 0.6 to 4 mm, and/or particles of natural materials having a diameter of from 0.05 to 4 mm selected from the group consisting of comminuted nut shells, comminuted fruit stones, optionally comminuted fruit kernels. comminuted plant roots, and/or comminuted plant bark.

2. The product of claim 1, comprising 0.05 to 10% by weight of the abrasive.

3. The product of claim 2, comprising 0.3 to 2% by weight of the abrasive.

4. The product of claim 1, further comprising at least one anionic surfactant selected from the group consisting of aliphatic sulfates, fatty alcohol sulfates, fatty alcohol ether sulfates, dialkyl ether sulfates, dialkyl ether monoglyceride sulfates, aliphatic sulfonates, alkanesulfonates, olefinsulfonates, ether sulfonates, n-alkyl ether sulfonates, ester sulfonates, lignosulfonates, alkylbenzenesulfonates, fatty acid cyanamides, sulfosuccinic esters, fatty acid isothionates, acylaminoalkane sulfonates, fatty acid sarcosinates, ether carboxylic acids, alkyl (ether) phosphates, and any mixtures thereof.

5. The product of claim 1, further comprising at least one nonionic surfactant, selected from the group consisting of alkylpolyglycosides, fatty alcohol polyglycol ethers, fatty acid glucamides, fatty acid alkanolamides and mixtures thereof.

6. The product of claim 1, comprising a polymeric thickener selected from the group consisting of polycarboxylates, homo- and copolymers of acrylic acid, polysaccharides, and mixtures thereof.

7. The product of claim 6, wherein the polymeric thickener comprises xanthan gum and/or gellan gum.

8. The product of claim 1, comprising 0.01 to 8% by weight of a polymeric thickener.

9. The product of claim 1, comprising 0.1 to 6% by weight of a polymeric thickener.

10. The product of claim 1, comprising 0.5 to 3% by weight of a polymeric thickener.

11. The product of claim 1, comprising one or more solvents.

12. The product of claim 11, wherein the solvents comprise one or more low molecular weight alcohols.

13. The product of claim 11, comprising 0.1 to 12% by weight of the solvent(s).

14. The product of claim 13, comprising 1 to 10% by weight of the solvent(s).

15. The product of claim 1, comprising one or more components selected from the group consisting of dicarboxylic acids and salts thereof, other organic acids and salts thereof, inorganic salts, and any mixtures thereof.

16. The product of claim 1, having a viscosity at a shear rate of 0.3 rpm of 2,500 to 100,000 mPa.s, a viscosity at a shear rate of 3 rpm of 1,200- to 10,000 mPa.s, and a viscosity at a shear rate of 30 rpm of 250 to 2,500 mPa.s, measured with a Brookfield viscometer DV II +, spindle 31, 2 min., 20° C.

17. The product of claim 16, having a viscosity at a shear rate of 0.3 rpm of 3,000 to 90,000 mPa.s, a viscosity at a shear rate of 3 rpm of 1,500 to 9,000 mPa.s, and a viscosity at a shear rate of 30 rpm of 300 to 2,000 mPa.s, measured with a Brookfield viscometer DV II +, spindle 31, 2 min., 20° C.

18. The product of claim 1, comprising one or more additives selected from the group consisting of UV stabilizers, perfumes, dyes, polymers, soil-releasers, gloss-enhancing substances, hydrotropes, cleaning enhancers, pH regulators, disinfectants, antistats, corrosion inhibitors, preservatives, enzymes, optical brighteners, and skin protectants.

19. The product of claim 18, comprising not more than 12% by weight of the one or more additives.

20. The product of claim 19, comprising 0.01 to 7% by weight of the one or more additives.

21. The product of claim 20, comprising 0.1 to 4% by, weight of the one or more additives.

22. The product of claim 1, having a pH of 3 to 10.

23. The product of claim 1, having a pH of 4 to 8.

* * * * *